United States Patent [19]

Würmli

[11] 4,244,177

[45] Jan. 13, 1981

[54] THREAD GUIDE FOR RING SPINNING AND RING TWISTING MACHINES

[75] Inventor: Arthur Würmli, Winterthur, Switzerland

[73] Assignee: Rieter Machine Works Ltd., Winterthur, Switzerland

[21] Appl. No.: 118,086

[22] Filed: Feb. 4, 1980

[30] Foreign Application Priority Data

Feb. 23, 1979 [CH] Switzerland ..... 1797/79

[51] Int. Cl.[3] ..... D01H 1/42; B65H 59/00

[52] U.S. Cl. ..... 57/353; 242/157 C

[58] Field of Search ..... 57/352, 353, 354, 356; 242/157 C

[56] References Cited

U.S. PATENT DOCUMENTS

| | | | |
|---|---|---|---|
| 275,020 | 4/1883 | Chase | 57/353 |
| 413,746 | 10/1889 | Wilmarth | 57/353 |
| 687,981 | 12/1901 | Eastwood | 57/353 |
| 1,001,119 | 8/1911 | Aldrich | 242/157 C |
| 1,117,596 | 11/1914 | O'Connell | 242/157 C |
| 1,624,934 | 4/1927 | Elliott | 57/353 |

*Primary Examiner*—Donald Watkins

*Attorney, Agent, or Firm*—Werner W. Kleeman

[57] ABSTRACT

The thread guide arrangement for ring spinning and ring twisting machines comprises a thread guide lappet (6) and a wire-shaped thread guide eyelet (3), defining the thread balloon point, and mounted using a screw (13), which screw (13) is provided with an extension (13*a*) acting as a thread catching device, and which thus prevents the occurrence of multiple end breakages in a row. For easier removal of thread remnants, the extension (13*a*) can be smooth. The screw (13) furthermore is used for centerably mounting the thread guide eyelet (3) with respect to the spindle axis (a).

9 Claims, 4 Drawing Figures

THREAD GUIDE FOR RING SPINNING AND RING TWISTING MACHINES

Figure 1:
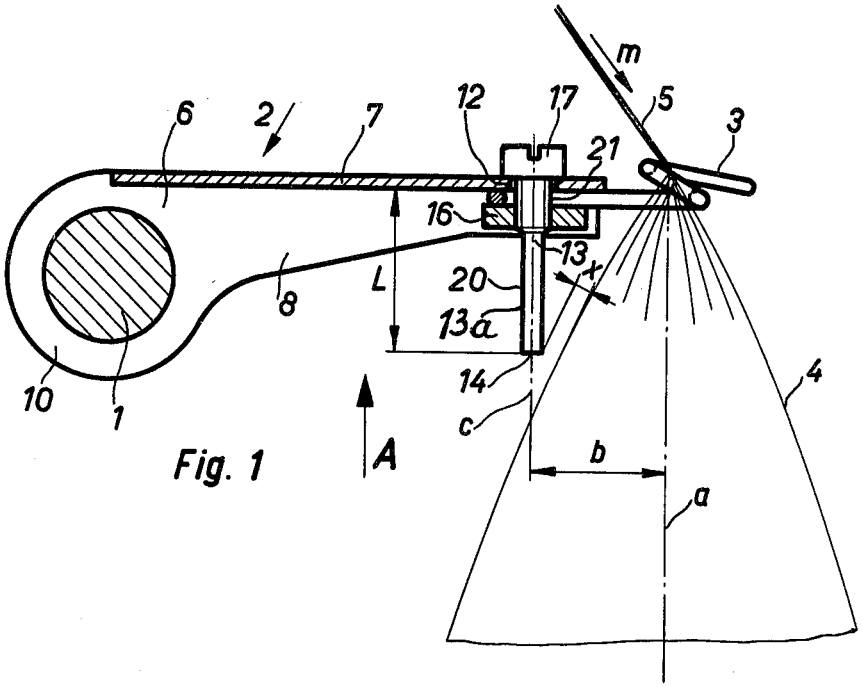

The present invention concerns a thread guide for ring spinning and ring twisting machines, with a thread guide lappet, with a thread guide eyelet formed by a wire wound in approximately helical shape, which is mounted to the thread guide lappet, and which defines the point of the thread balloon, and with a thread catching device.

The term thread catching device is understood to describe a substantially straight, cylindrical body arranged in the vicinity of the thread guide eyelet, which does not contact the thread balloon during normal operation, and the function of which is to catch the thread immediately under abnormal operating conditions caused by excessive widening of the balloon below the thread guide (broken traveller, weight of traveller too low, etc.) and thus to prevent tangling of the thread with the threads running correctly on adjacent spindles which can cause further thread end breakages.

Thread guides of the type mentioned above are known (e.g. from Swiss Pat. No. 379,981) in which the catching device is formed in one piece as an extension of the thread eyelet, the helically wound wire, being extended downward and to the front, forming the thread catching device.

In this thread guide arrangement the thread eyelet is connected to the thread guide lappet using a screw in such manner that centering of the thread guide eyelet with respect to the spindle axis is possible only under certain conditions, or under application of further additional provisions, respectively.

The thread guide described shows the disadvantage that the thread guide is placed at the foremost, most exposed position within the machine, where it often is subject to mechanical damage. Frequently thus damaged thread guide eyelets have to be replaced which increases maintenance costs.

In a further known thread guide arrangement (Swiss Pat. No. 470,502) the thread catching arrangement is formed by a wire welded to the thread guide eyelet wire behind the eyelet. This arrangement shows the disadvantage that manufacture of such welded wire arrangements is expensive and that the welding seam tends to cause undesirable fly waste accumulations.

It is thus the objective of the present invention to create a thread guide arrangement for ring spinning and twisting machines of the type initially mentioned, which eliminates the disadvantages of the known thread guide arrangements of this type, and which is inexpensive and simple in manufacture, robust, reliable and easy to operate.

This objective is achieved by a thread guide arrangement for ring spinning and ring twisting machines with a thread guide lappet, a thread guide eyelet formed by an approximately helically wound wire, which is mounted to the thread guide lappet using a screw and which defines the point of the thread balloon, in that the thread catching device located below the thread guide eyelet consists of an extension of the mounting screw, extending downward in its working position.

Due to the choosing of a mounting screw (required anyhow for mounting purposes) of a greater length, provision of a more expensive design of thread guide arangement with a "built-in" thread catching arrangement can be dispensed with if the inventive thread guide arrangement is used. The thread catching device, which thus is placed in an optimum location behind the thread guide eyelet and below the thread guide lappet, thus does not cause any additional costs.

In a preferred embodiment of the thread guide arrangement the extension extends substantially parallel to the rotational axis of the thread balloon.

In a further preferred embodiment of the thread guide arrangement the thread guide eyelet comprises a bent end portion located in a plane, and which is clamped between the thread guide lappet and a nut for the mounting screw, such that it can be mounted centered in a plane at right angles to the spindle axis. Owing to this design of the thread guide eyelet, the thread guide eyelet can be centered with respect to the spindle axis easily and accurately, using the mounting screw which also forms the thread catching device, in such manner that working conditions of the spinning position are improved and that thread tension can be levelled and thread breakage frequency can be reduced.

In a further embodiment of the thread guide arrangement the mounting screw extension consists of an unthreaded cylindrical portion, the diameter of which is smaller than the core diameter of mounting screw thread. This particular design of the thread catching device presents the advantage, that yarn or thread remnants wound around the thread catching device in case of a end breakage are easily removed by hand.

Furthermore it proves advantageous, if the nut is designed as a small plate, one lateral limitation of which laterally hugs at least one leg of the thread guide lappet. Thus centering of the thread guide eyelet with respect to the spindle axis is rendered very easy, as the operator with one hand can center the thread guide eyelet and with the other hand can tighten the mounting screw without bothering about holding the nut.

Furthermore the end portion of the thread guide eyelet can be bent in U-shape or in circular shape.

Figure 2:
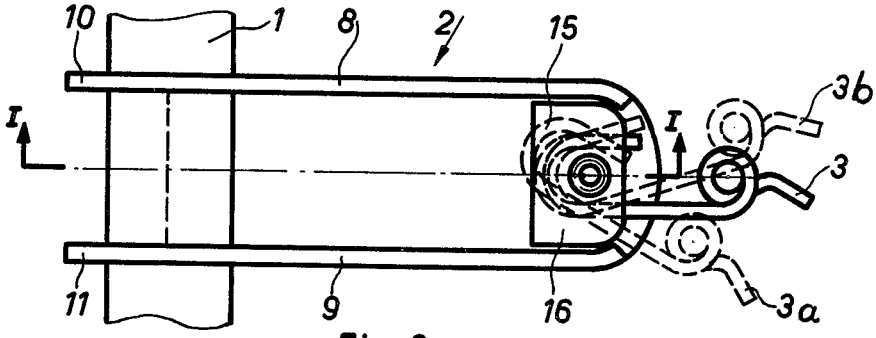

The invention is described in more detail in the following with reference to illustrated design examples. It is shown in:

FIG. 1 a thread guide arrangement shown in a section along line I—I of FIG. 2, FIG. 2 the thread guide arrangement according to FIG. 1 seen in the direction of arrow A of FIG. 1

Figure 3:
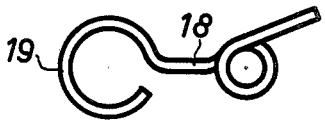
Figure 4:
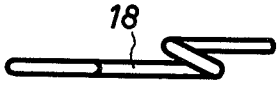

FIG. 3 a view of a further alternative design example of a thread guide eyelet, and in FIG. 4 the thread guide eyelet of FIG. 3 seen in a lateral view.

In FIG. 1 a portion of a ring spinning or a ring twisting machine is shown, comprising for simplicity reasons only those elements, which are required in describing the present invention.

At each spinning position a shaft 1 (FIGS. 1 and 2) supports a thread guide arrangement 2 forming with its thread guide eyelet 3 the point of a thread balloon 4 (the upper portion of which is shown only) rotating about a spindle (not shown). The thread is supplied by a drafting arrangement, not shown, in the direction of the arrow m, the twist being imparted to the thread portion 5 extending between the drafting arrangement and the thread guide eyelet 3 by the rotation of the thread balloon 4.

The thread guide arrangement 2 comprises a thread guide lappet 6, consisting of a horizontal yoke 7 and of two legs 8 and 9 extending at right angles with respect to the yoke 7. The legs 8 and 9 are provided each with a lug 10 and 11 through which bores pass for taking up the shaft 1. The shaft 1, extending over the whole length of the machine, forms the pivoting axis of the thread guide arrangement 2. In this arrangement it is of no consequence in this context, whether the thread guide arrangement 2 is arranged pivotable on the shaft 1, while the shaft 1 is at a standstill, and can be fixed in the working position shown in FIG. 1 using means not shown, or whether the thread guide arrangement 2 is pivoted together with the shaft 1 as the latter is pivoted.

In the front portion, and at the centre of the yoke 7 a bore 12 is provided, through which a screw 13 passes. The screw 13 is provided with an extension 13*a*, positioned such and of a length such that its free end 14 is located at a distance x from the rotational surface swept by the thread balloon. In this arrangement the length L of the screw 13 and the distance b of the axis c of the screw 13 from the spindle axis a are to be chosen such that the distance x between balloon rotational surface and the outermost point of the screw 13 closest to it is never smaller than a minimum value ranging from 1 to 20 mm, preferentially ranging from 5 to 10 mm. This measure ensures that the fact, that the balloon diameter at a given spindle and between spindles can slightly vary as a function of a large number of factors, of which thread tension is the predominant one, is taken care of.

The screw 13 at the same time is used for mounting the thread guide eyelet 3, formed of a wire, preferentially of a wire of circular cross-section, to the lower side of the yoke 7, which is achieved in that the mounting portion 15 (FIG. 2), bent in U-shape and arranged in a plane, of the thread guide eyelet 3 is clamped between the lower side of the yoke 7 and a nut 16, formed e.g. as a small plate. The screw thus is used as a mounting means and as a thread catching device and thus fulfills an advantageous double function. In this arrangement the distance between the legs of the U-shaped mounting portion 15 is greater than the diameter of the screw 13.

Owing to this mounting of the thread guide eyelet 3 in the thread guide arrangement 2, optimum centerability of the eyelet with respect to the spindle axis a is achieved. In FIG. 2 one position of the thread guide eyelet 3 is shown in solid lines and two further positions 3*a* and 3*b* of the thread guide eyelet are indicated as examples in broken lines. Owing to the U-shaped mounting portion 15, the thread guide eyelet is provided with a double moveability with respect to the screw 13 in a plane (not shown) at right angles with respect to the spindle axis a. Thus, large differences in position between the thread guide arrangement 2 and the spindle axis a, which in view of the total length of the machine easily may occur, can be evened out without difficulties.

For facilitating the centering operating of the thread guide eyelet 3 it proves advantageous if the nut 16 shaped as a small plate with a limitation laterally hugging at least one leg 8 or 9 of the thread guide lappet 6 is formed in such manner that it cannot rotate while the mounting screw 13 is tightened. In this case the operator can tighten the screw 13 with one hand, while he can hold, or adjust respectively, the thread guide eyelet 3 with the other free hand.

In FIG. 1 furthermore it is shown, that the extension of the mounting screw 13 consists of a cylindrical, unthreaded portion 20, the diameter of which is smaller than the core diameter of the thread 21 of the screw 13. Experience has shown that also a smooth cylinder is well suited for catching threads, provided that the distance x is chosen correctly. If in case of a thread breakage the thread is wrapped about the portion 20, the remaining thread remnants are to be eliminated before the spinning position is restarted, which is achieved by wiping the thread off the thread catching device by hand. A smooth surface of the portion 20 of the screw 13, used as a thread catching device presents considerable advantages, as thread remnants wrapped around it can be removed without difficulties.

For this operation advantageously the thread guide arrangement 2 is pivoted up about the shaft 1, in such manner that removal of the thread remnants from the thread catching device, or from its smooth portion 20, is effected more easily from the front.

In FIGS. 3 and 4 an alternative design example is shown of a thread guide eyelet 18 to be mounted in the thread guide arrangement, which differs from the thread guide eyelet 3 according to FIGS. 1 and 2 substantially in that instead of a mounting portion bent in U-shape a mounting portion 19 bent in circular shape is provided, in which, for ensuring centerability of the thread guide eyelet 18 with respect to the spindle axis a, the inside diameter of the circular mounting portion 19 is chosen larger than the diameter of the screw 13.

It will be appreciated from the above description that the invention provides a device for use as a thread guide at the apex of a thread balloon, for example a balloon of the type formed in ring spinning or ring twisting machines, said device comprising a thread guide for guiding thread at said apex and securing means adapted to secure the thread guide to a support therefor, said securing means being also adapted to provide means to catch the thread under abnormal operating conditions.

Said means to catch the thread may be a thread catching device as defined above.

Said securing means may be adapted to provide said means to catch the thread in that the securing means is provided with an extension to extend to a position adjacent the balloon in use. The extension may be integral with the securing means, or part thereof, or it may be formed separately from and attachable to the securing means.

The device may further comprise the support itself which may be adapted to be mounted on a machine frame e.g. by having one or more openings to receive a shaft in said frame.

The securing means may comprise an elongate member, preferably screw threaded, to secure the thread guide to the support, and the means to catch the thread may be provided by an extension of the elongate member, preferably integral therewith and preferably having a smooth external surface of a cross-section which facilitates removal of thread wraps by sliding them over a free end of the extension. However, the means to catch the thread could be provided by an extension formed integral with a nut which co-operates with a securing screw in use, or it could be formed separately from both the screw and the nut but attachable to one or both of them. A screw threaded connection to secure the thread guide is also not essential to the invention—a snap fit may be satisfactory in same circumstances.

It will be clear that in this invention, the means to catch the thread is separated from the thread guide and is mounted separately on the support, preferably by means of or as part of a securing means which secures the thread guide to the support.

I claim:

1. Thread guide for ring spinning and ring twisting machines, with a thread guide lappet, with a thread guide eyelet formed by a wire wound in approximately helical form, which is mounted onto the thread guide lappet using a screw, and which defines the point of the thread balloon, and with a thread catching device, characterized in that the thread catching device arranged below the thread guide eyelet (3,18) consists of an extension (13*a* ) of the mounting screw (13) extending downward in operating position.

2. Thread guide according to claim 1, characterized in that the extension (13*a*) extends substantially parallel to the rotational axis (a) of the balloon (4).

3. Thread guide according to claim 1, characterized in that the thread guide eyelet (3,18) comprises a bent mounting portion (15,19) contained in a plane, which mounting portion is clamped between the thread guide lappet (6) and a nut (16) for the mounting screw (13) for its centerable mounting in a plane extending at right angles to the spindle axis (a).

4. Thread guide according to claim 1, characterized in that the extension (13*a*) of the mounting screw (13) consists of a cylindrical unthreaded portion (20), the diameter of which is smaller than the core diameter of the thread (21) of the mounting screw (13).

5. Thread guide according to claim 3, characterized in that the nut (16) is formed as a small plate, the lateral limitation of which is chosen such as to be adjacent to at least one leg (8 or 9) of the thread guide lappet.

6. Thread guide according to claim 3, characterized in that the mounting portion (15) of the thread guide eyelet (3) is bent in U-shape and that the distance between the legs of the U-shaped end portion (15) is greater than the diameter of the screw (13).

7. Thread guide according to claim 3, characterized in that the mounting portion (19) of the thread guide eyelet (18) is bent in circular shape and that the inside diameter of the end portion (19) is greater than the diameter of the screw (13).

8. A device for use as a thread guide at the apex of a thread balloon, said device comprising a thread guide for guiding thread at said apex and a securing means adapted to secure the thread guide to a support therefor, said securing means being also adapted to provide means to catch a thread under abnormal operating conditions.

9. A device as claimed in claim 8, wherein said securing means comprises a member screw threaded on at least a portion thereof to enable it to secure the thread guide to the support, said means to catch the thread being provided by an extension on said member.

* * * * *